US005115117A

United States Patent [19]

Amiot et al.

[11] Patent Number: 5,115,117

[45] Date of Patent: May 19, 1992

[54] STEAM IRON PROVIDED WITH AN INTERMEDIATE VAPORIZATION CHAMBER TO PREVENT EXPULSION OF UNVAPORIZED WATER THROUGH THE STEAM OUTLET ORIFICES

[75] Inventors: Jacques H. J. Amiot; Jean-Paul A. A. Bouleau; Gerard R. M. Molveaux, all of Alencon, France

[73] Assignee: Moulinex (Societe Anonyme), Bagnolet, France

[21] Appl. No.: 600,992

[22] Filed: Oct. 23, 1990

[30] Foreign Application Priority Data

Nov. 7, 1989 [FR] France ..... 89 14598

[51] Int. Cl.[5] ..... D06F 75/18; H05B 3/00

[52] U.S. Cl. ..... 219/254; 38/77.83; 38/82; 392/399; 239/136

[58] Field of Search ..... 219/245-259; 38/75, 74, 77.1-77.9, 82; 239/136

[56] References Cited

U.S. PATENT DOCUMENTS 2,700,236 1/1955 Marvin et al. ..... 38/77.83
3,136,080 6/1964 Albrecht ..... 38/77.7
3,703,777 11/1972 Knapp ..... 38/77.83
4,711,010 12/1987 Walter ..... 38/77.83 X

FOREIGN PATENT DOCUMENTS 2654781 12/1977 Fed. Rep. of Germany .
3205333 8/1983 Fed. Rep. of Germany .

*Primary Examiner*—Anthony Bartis
*Attorney, Agent, or Firm*—Young & Thompson

[57] ABSTRACT

Electric iron having a cast sole (1A) closed by a cover (2) and in which are provided two chambers (6, 7) separated from each other by a partition (8), namely, a principal vaporization chamber (6) fed with water by an injection device through an opening (9) provided in the cover (2), the water being vaporized by a sheathed resistance (10) embedded in the sole (1A), and a steam distribution chamber (7) communicating on the one hand with the principal vaporization chamber (6) by a passage (11) provided in the partition (8), and on the other hand with the exterior through outlet orifices (12) provided in the sole (1A). The sole (1A) also comprises an intermediate vaporization chamber (15) disposed between the principal vaporization chamber (6) and the distribution chamber (7) and extending adjacent the injection opening (9) of the water. Intermediate vaporization chamber (15) is a closed space delimited by a counter-partition (16) arranged between the injection opening (9) and the partition (8) and extending from the sole (1A) to the cover (2).

4 Claims, 1 Drawing Sheet

STEAM IRON PROVIDED WITH AN INTERMEDIATE VAPORIZATION CHAMBER TO PREVENT EXPULSION OF UNVAPORIZED WATER THROUGH THE STEAM OUTLET ORIFICES

The invention relates to electric steam irons.

The invention more particularly concerns an electric iron having a cast sole closed by a cover and in which are provided two chambers separated by a partition, namely a so-called principal vaporization chamber fed by water by means of an injection device through an opening provided in the cover, the water being vaporized by a sheathed resistance embedded in the sole, and a steam distribution chamber communicating on the one hand with the vaporization chamber through at least one passageway provided in the partition, and on the other hand with the exterior through outlet orifices provided in the sole.

Known irons of this type often have the drawback of not being completely leakproof between the principal vaporization chamber and the distribution chamber. Thus, because of a manufacturing or assembly fault, a certain play can exist between the cover and the partition separating the two chambers, such that unvaporized water can pass directly from the vaporization chamber to the distribution chamber, with the danger that water may be expelled through the outlet orifices. The ejected water soils the laundry, which detracts from the quality of the pressing. To overcome this drawback, recourse can be had to silicone joints which unfortunately are quite expensive.

The present invention has for its object to overcome these drawbacks and to provide an improved pressing iron, adapted to be mass produced, of particularly moderate cost and permitting high quality ironing.

According to the invention, the sole comprises also a second so-called intermediate vaporization chamber between the principal vaporization chamber and the distribution chamber and extending into the vicinity of the injection opening for the water.

Thus, by the interposition of an intermediate chamber between the principal vaporization chamber and the distribution chamber, the unvaporized water which succeeds in passing between the cover and the counter-partition for separating the two vaporization chambers will be vaporized in the intermediate chamber, thus avoiding any projection of water through the outlet orifices.

The characteristics and advantages of the invention will be further apparent from the description which follows, by way of example, with reference to the accompanying drawing, in which.

Figure 1:
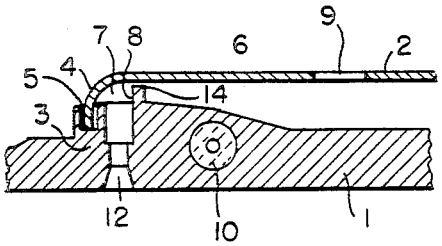
(PRIOR ART) FIG. 1
FIG. 1 is a fragmentary transverse cross sectional view of a pressing iron sole according to the prior art.

An electric pressing iron such as illustrated in FIGS. 1 to 4 comprises a cast sole 1, closed by a cover 2 of sheet metal by means of a peripheral groove 3 of shallow depth provided in the upper surface of the sole thereby to receive the curved peripheral margin 4 of the cover 2 with a suitable joint 5 to ensure fluidtightness of the assembly. The cover 2 is also maintained on the sole 1 by means of gripping elements (not shown).

In sole 1 are provided two chambers 6, 7, a so-called principal vaporization chamber 6 and a distribution chamber 7, separated from each other by a vertical partition 8 extending from the sole 1 to the cover 2. The principal vaporization chamber 6 is fed with water by means of an injection device (not shown) through an opening 9 provided in the cover 2, the water being vaporized by a sheathed electrical resistance 10 embedded in the sole 1, and having a U-shape (shown in broken line in FIG. 3), the principal vaporization chamber 6 being disposed between the legs of the U. The vapor distribution chamber 7 communicates on the one hand with the principal vaporization chamber 6 by means of two passages 11 provided in the partition 8, and, on the other hand, with the exterior by means of outlet orifices 12 provided in the lower surface of the sole 1. Thus water falls through the injection opening 9 in the principal vaporization chamber 6. This water is vaporized thanks to the heat of the sheathed resistance 10. The vapor flows between the baffles 13 through the passages 11 from the distribution chamber 7 and escapes by outlet orifices 12.

As can be seen in FIG. 1, in a known pressing iron, if expensive silicone joints are not to be used, there should exist a small play 14 between the partition 8 and the cover 2, due to mass production manufacturing techniques (casting, shaping ...) The play permits unvaporized water drops to pass between the partition 8 and the cover 2 directly from the principal vaporization chamber 6 to the distribution chamber 7 without passing the baffles 13 and thus there is produced by the outlet orifices 12 jets of water which are troublesome during ironing.

Figure 2:
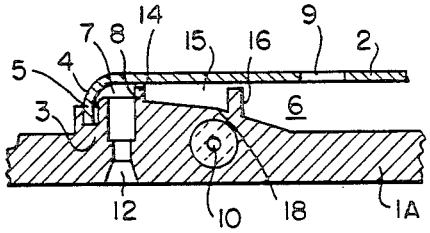
FIG. 2 is a partial transverse cross sectional view of the sole of an iron according to the invention.
Figure 3:
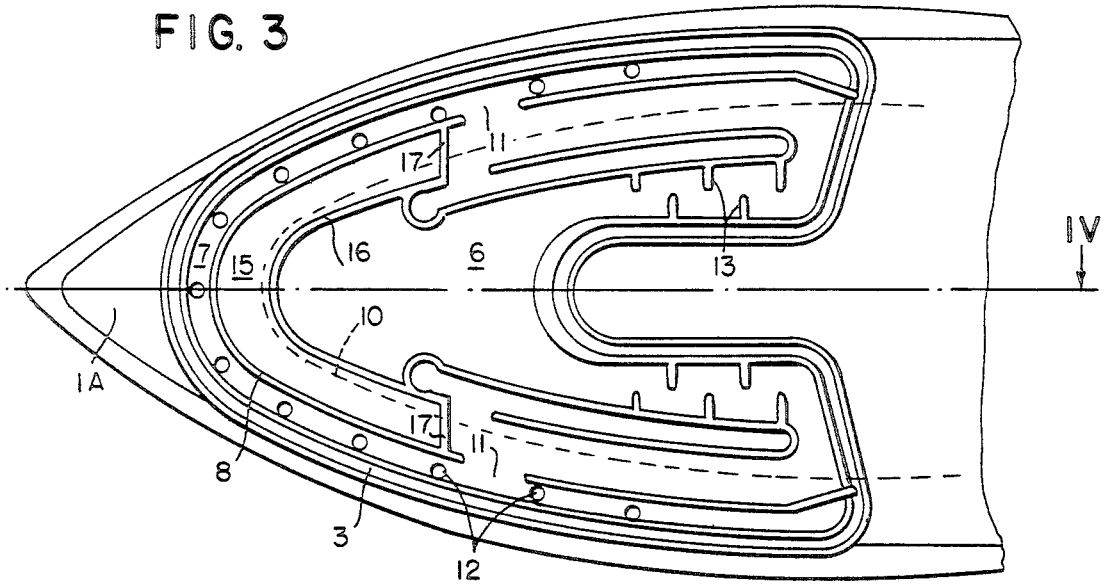
FIG. 3 is a partial view (on a smaller scale) from above of a sole according to the invention, the cover being omitted.
Figure 4:
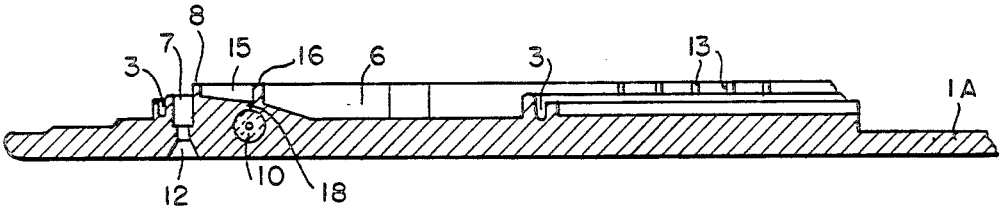
FIG. 4 is a section on the line IV—IV of FIG. 3.

According to the invention, the sole 1*a* of the pressing iron, as shown in FIGS. 2 to 4, comprises also a second so-called intermediate vaporization chamber 15 arranged between the principal vaporization chamber 6 and the distribution chamber 7 and extending adjacent the injection opening 9 for water. The intermediate vaporization chamber 15 is a closed space delimited by a vertical counter-partition 16 arranged between the injection opening 9 and the partition 8 and extending from the sole 1*a* to the cover 2. The counter-partition 16 is secured at its ends 17 to the partition 8. Thus, unvaporized water which succeeds in passing between the cover 2 and the counter partition 16 is automatically vaporized in the intermediate vaporization chamber 15, the steam escaping through the clearance 14 between the partition 8 and the cover 2 toward the distribution chamber 7.

The water injection opening 9 being located in the intermediate forward portion of the principal vaporization chamber 6, the intermediate vaporization chamber 15 is disposed substantially above the sheathed resistance 10 and in front of the principal vaporization chamber 6. Moreover, the intermediate vaporization chamber 15 has an inclined bottom whose lowermost point 18 is located above the resistance 10. Thus, any drop of water entering the intermediate chamber 15 is instantaneously vaporized.

What is claimed is:

1. Electric iron comprising a cast sole (1A) closed by a cover (2) and in which are provided two chambers (6, 7) separated from each other by a partition (8), namely a principal vaporization chamber (6) fed with water by an injection device through an opening (9) provided in the cover (2), the water being vaporized by a sheathed resistance (10) embedded in the sole (1A), and a steam distribution chamber (7) communicating on the one hand with the principal vaporization chamber (6) by means of a passage (11) provided in the partition (8), and on the other hand with the exterior through outlet orifices (12) provided in the sole (1A), wherein the sole (1A) also comprises an intermediate vaporization chamber (15) disposed between the principal vaporization chamber (6) and the distribution chamber (7) and extending adjacent the injection opening (9) of the water, the intermediate vaporization chamber (15) comprising a closed space delimited by a continuous counter-partition (16) arranged between the injection opening (9) and the partition (8) and extending from the sole (1A) to the cover (2).

2. Iron according to claim 1, wherein the sheathed resistance (10) has a U-shape between the legs of which is disposed the principal vaporization chamber (6), the opening (9) for injection of water is situated in the forward medial portion of the principal vaporization chamber (6), and the intermediate vaporization chamber (15) is disposed substantially above the sheathed resistance (10) and in front of the principal vaporization chamber (6).

3. Iron according to claim 2, wherein the intermediate vaporization chamber (15) has an inclined bottom whose lowermost point (18) is located above the resistance (10).

4. Iron according to claim 1, wherein the cover (2) is of sheet metal and its peripheral edge (4) is enclosed in a complementary groove (3) provided in the sole (1).

* * * * *